US008510871B2

(12) United States Patent
Blackford et al.

(10) Patent No.: US 8,510,871 B2
(45) **Date of Patent: *Aug. 20, 2013**

(54) HOLOGRAPHIC PATTERNED HEAT MANAGEMENT MATERIAL

(75) Inventors: Michael E. "Woody" Blackford, Portland, OR (US); Jeffrey Mergy, Portland, OR (US)

(73) Assignee: Columbia Sportswear North America, Inc., Portland, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/101,021

(22) Filed: May 4, 2011

(65) Prior Publication Data

US 2011/0203783 A1 Aug. 25, 2011

Related U.S. Application Data

(63) Continuation-in-part of application No. 12/776,306, filed on May 7, 2010, now Pat. No. 8,453,270, and a continuation-in-part of application No. 29/385,768, filed on Feb. 18, 2011, now Pat. No. Des. 670,917, and a continuation-in-part of application No. 29/360,364, filed on Apr. 23, 2010, now Pat. No. Des. 670,435, and a continuation-in-part of application No. 29/346,787, filed on Nov. 5, 2009, now Pat. No. Des. 655,921, and a continuation-in-part of application No. 29/346,784, filed on Nov. 5, 2009, now Pat. No. Des. 656,741, and a continuation-in-part of application No. 29/346,785, filed on Nov. 5, 2009, now Pat. No. Des. 653,400, and a continuation-in-part of application No. 29/346,786, filed on Nov. 5, 2009, now Pat. No. Des. 657,093, and a continuation-in-part of application No. 29/346,788, filed on Nov. 5, 2009, now Pat. No. Des. 651,352, and a continuation-in-part of application No. 29/336,730, filed on May 7, 2009, now Pat. No. Des. 650,529.

(60) Provisional application No. 61/176,448, filed on May 7, 2009.

(51) Int. Cl.

| | |
|---|---|
| ***A41D 27/02*** | (2006.01) |
| ***A62B 17/00*** | (2006.01) |
| *A41D 13/01* | (2006.01) |
| *A41D 31/02* | (2006.01) |

(52) U.S. Cl.
USPC ..... 2/456; 2/457; 2/81; 2/82; 2/97; 2/272

(58) Field of Classification Search
USPC ..... 2/455, 456, 457, 458, 7, 81, 82, 97, 2/164, 167, 272, 905, 906
See application file for complete search history.

(56) References Cited

U.S. PATENT DOCUMENTS

| | | | |
|---|---|---|---|
| 2,695,895 | A | 11/1954 | Barnard et al. |
| 2,759,522 | A | 8/1956 | Limm et al. |

(Continued)

FOREIGN PATENT DOCUMENTS

| | | |
|---|---|---|
| DE | 9409799 | 4/1995 |
| EP | 0917888 | 5/1999 |

(Continued)

OTHER PUBLICATIONS

Castelli Insolito Radiation Jacket—3 Season Cycling Jacket; www.feedthehabit.com/road-biking/castelli-insolito-radiation-jacket-3-season-cycling-jacket/; Sep. 19, 2008.

(Continued)

*Primary Examiner* — Bobby Muromoto, Jr.
(74) *Attorney, Agent, or Firm* — Schwabe, Williamson & Wyatt, P.C.

(57) ABSTRACT

Embodiments provide body gear having designed performance characteristics, and in particular methods and apparatuses that utilize an array of holographic heat managing elements coupled to a base material to direct body heat while also maintaining the desired transfer properties of the base material. In some embodiments, the heat managing elements include heat-directing elements that reflect heat or conduct heat, and that may direct heat towards the body of a user or away from the body of the user.

27 Claims, 14 Drawing Sheets

(56) References Cited

U.S. PATENT DOCUMENTS

| | | | | |
|---|---|---|---|---|
| 3,577,305 | A | 5/1971 | Hines et al. | |
| 3,663,182 | A * | 5/1972 | Hamling | 442/181 |
| 3,849,802 | A * | 11/1974 | Govaars | 2/81 |
| 4,032,681 | A * | 6/1977 | Jonnes | 442/317 |
| 4,211,261 | A * | 7/1980 | Mehta et al. | 139/425 R |
| 4,395,455 | A * | 7/1983 | Frankosky | 428/332 |
| 4,420,521 | A | 12/1983 | Carr | |
| 4,435,442 | A * | 3/1984 | Hefele | 427/465 |
| 4,463,464 | A * | 8/1984 | Bost et al. | 297/452.61 |
| 4,483,021 | A * | 11/1984 | McCall | 2/7 |
| 4,525,406 | A | 6/1985 | Pollock | |
| 4,569,088 | A * | 2/1986 | Frankenburg et al. | 2/81 |
| 4,569,874 | A | 2/1986 | Kuznetz | |
| 4,622,253 | A * | 11/1986 | Levy | 428/91 |
| 4,637,947 | A * | 1/1987 | Maekawa et al. | 428/68 |
| 4,712,609 | A * | 12/1987 | Iversen | 165/80.4 |
| 4,765,323 | A | 8/1988 | Poettgen | |
| 4,856,294 | A | 8/1989 | Scaringe et al. | |
| 4,912,778 | A | 4/1990 | Daniels | |
| 5,098,795 | A * | 3/1992 | Webb et al. | 428/594 |
| 5,207,852 | A | 5/1993 | Lightle et al. | |
| 5,415,222 | A | 5/1995 | Colvin | |
| 5,860,163 | A | 1/1999 | Aldridge | |
| 6,009,560 | A | 1/2000 | McKenney et al. | |
| 6,110,558 | A | 8/2000 | Billingsley et al. | |
| 6,191,056 | B1 * | 2/2001 | Vogt et al. | 442/148 |
| 6,242,369 | B1 * | 6/2001 | Vogt et al. | 442/148 |
| 6,319,599 | B1 | 11/2001 | Buckley | |
| 6,321,386 | B1 * | 11/2001 | Monica | 2/7 |
| 6,341,384 | B1 * | 1/2002 | Hayes | 2/458 |
| 6,427,242 | B1 | 8/2002 | Bush et al. | |
| 6,511,929 | B1 * | 1/2003 | Vogt et al. | 442/228 |
| 6,591,560 | B2 | 7/2003 | Burke, III et al. | |
| 6,824,819 | B2 * | 11/2004 | Vogt et al. | 427/203 |
| 6,855,410 | B2 | 2/2005 | Buckley | |
| 6,858,068 | B2 * | 2/2005 | Smith et al. | 96/127 |
| 6,874,336 | B2 * | 4/2005 | Yarborough et al. | 66/174 |
| 6,934,985 | B2 | 8/2005 | Sanders | |
| 7,399,919 | B2 * | 7/2008 | McCutcheon et al. | 174/16.3 |
| 7,452,833 | B2 | 11/2008 | Russell et al. | |
| 7,600,269 | B2 | 10/2009 | Feduzi et al. | |
| 7,739,749 | B2 | 6/2010 | Grilliot et al. | |
| 2002/0073481 | A1 | 6/2002 | Creagan et al. | |
| 2002/0166622 | A1 * | 11/2002 | Weder | 156/209 |
| 2003/0027476 | A1 * | 2/2003 | Vogt et al. | 442/380 |
| 2004/0128747 | A1 | 7/2004 | Bumbarger et al. | |
| 2004/0261465 | A1 * | 12/2004 | Yarborough et al. | 66/169 R |
| 2005/0009429 | A1 | 1/2005 | Park et al. | |
| 2005/0077618 | A1 * | 4/2005 | McCutcheon et al. | 257/712 |
| 2005/0209663 | A1 * | 9/2005 | Hamilton et al. | 607/108 |
| 2005/0251900 | A1 * | 11/2005 | Harlacker | 2/457 |
| 2005/0252036 | A1 * | 11/2005 | Laska | 36/11.5 |
| 2006/0051559 | A1 | 3/2006 | Sleeman et al. | |
| 2006/0130367 | A1 | 6/2006 | Liu | |
| 2007/0037034 | A1 * | 2/2007 | Fisher et al. | 429/34 |
| 2007/0129767 | A1 * | 6/2007 | Wahlstrand | 607/33 |
| 2007/0267583 | A1 * | 11/2007 | Dodo | 250/493.1 |
| 2007/0267595 | A1 * | 11/2007 | Dodo | 252/67 |
| 2007/0277806 | A1 * | 12/2007 | Dodo | 126/263.02 |
| 2008/0030856 | A1 | 2/2008 | King | |
| 2008/0099188 | A1 * | 5/2008 | Touzov | 165/104.21 |
| 2008/0251062 | A1 * | 10/2008 | Dodo | 126/263.02 |
| 2008/0257333 | A1 * | 10/2008 | Dodo et al. | 126/263.09 |
| 2008/0282455 | A1 * | 11/2008 | Jones et al. | 2/458 |
| 2008/0283038 | A1 * | 11/2008 | Dodo | 126/263.06 |
| 2009/0000610 | A1 * | 1/2009 | Dodo | 126/263.01 |
| 2009/0209155 | A1 * | 8/2009 | Goulet | 442/234 |
| 2009/0258180 | A1 * | 10/2009 | Goulet | 428/72 |
| 2010/0071119 | A1 * | 3/2010 | Thatcher | 2/458 |
| 2010/0107657 | A1 * | 5/2010 | Vistakula | 62/3.5 |
| 2010/0138983 | A1 * | 6/2010 | Kim | 2/458 |
| 2010/0282433 | A1 * | 11/2010 | Blackford | 165/46 |
| 2010/0326710 | A1 | 12/2010 | Zhang | |
| 2011/0020599 | A1 | 1/2011 | Le Roy et al. | |
| 2011/0036282 | A1 | 2/2011 | Cote | |
| 2011/0107771 | A1 * | 5/2011 | Crist et al. | 62/3.3 |
| 2011/0135899 | A1 * | 6/2011 | Meltzer et al. | 428/217 |
| 2011/0138523 | A1 * | 6/2011 | Layson et al. | 2/458 |
| 2011/0160691 | A1 | 6/2011 | Ng et al. | |
| 2011/0203783 | A1 * | 8/2011 | Blackford et al. | 165/185 |
| 2011/0214221 | A1 * | 9/2011 | Munda | 2/161.1 |

FOREIGN PATENT DOCUMENTS

| | | |
|---|---|---|
| GB | 2073613 A | 10/1981 |
| GB | 2294426 | 5/1996 |
| GB | 2414960 | 12/2005 |
| JP | 63-125525 | 8/1988 |
| JP | 63-139147 | 9/1988 |
| JP | 2004338169 | 12/2004 |
| JP | 2008089863 | 4/2008 |
| KR | 10-2007-0052303 | 5/2007 |
| KR | 30560581 | 5/2010 |
| WO | 9749552 | 12/1997 |
| WO | 0259414 A2 | 1/2002 |
| WO | DM/064488 | 5/2003 |
| WO | DM/064044 | 7/2003 |
| WO | 2006/030254 | 3/2006 |
| WO | DM/067876 | 5/2006 |

OTHER PUBLICATIONS

Castelli Radiation Jacket; www.cyclingweekly.co.uk/archive/tech/322662/castelli-radiation-jacket-300.html; Mar. 10, 2009.

Quelle Catalog: RU, Jacket Advertisement, 2005.

Sunmore, Poe Yoga Mat, Sporting Goods Buyers' Guide, Spring 2008.

YPCYC Catalog, Kompendium: Sportmode, kettenwirk-praxis, Obertshausen, 2006.

* cited by examiner

FIG. 1A
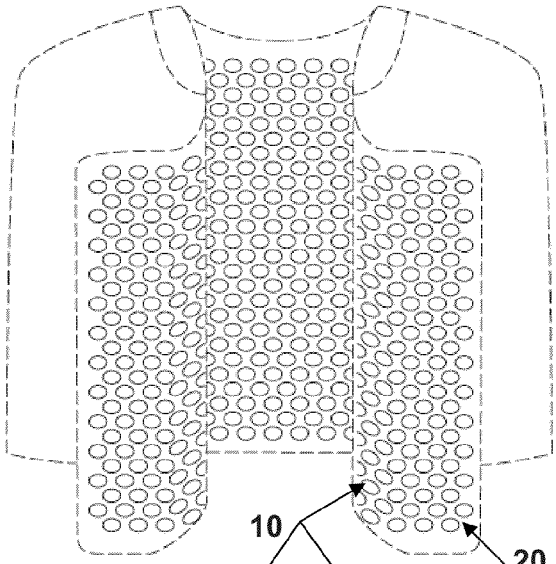
FIG. 1B
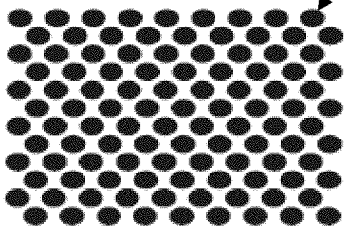
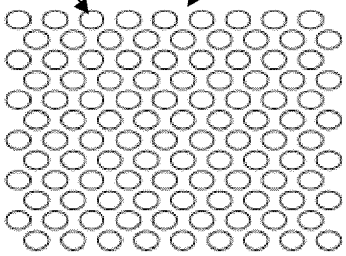
FIG. 1C
FIG. 1D
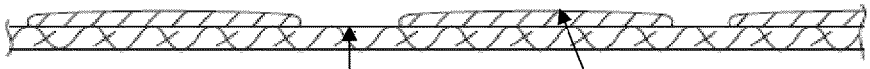
FIG. 1E
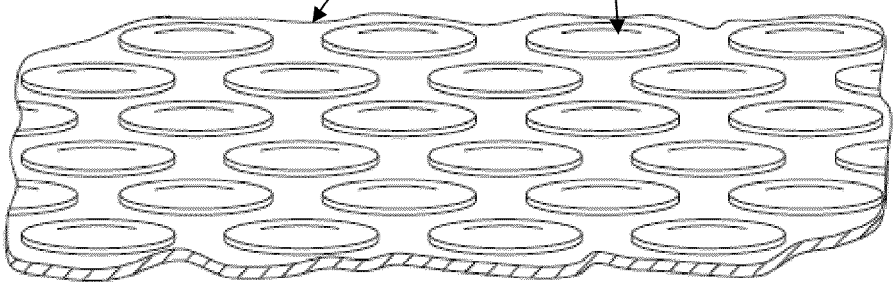

FIG. 8A
FIG. 8B
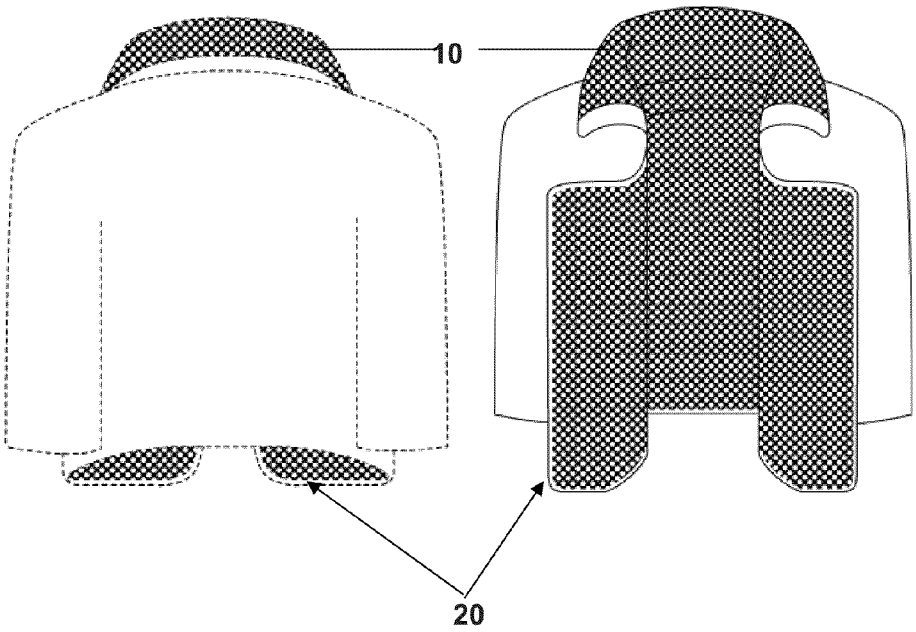
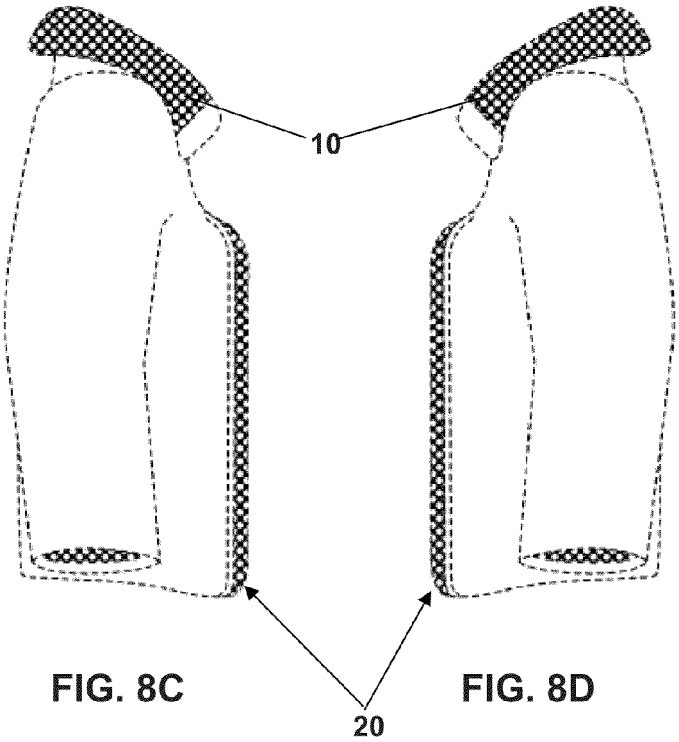
FIG. 8C
FIG. 8D

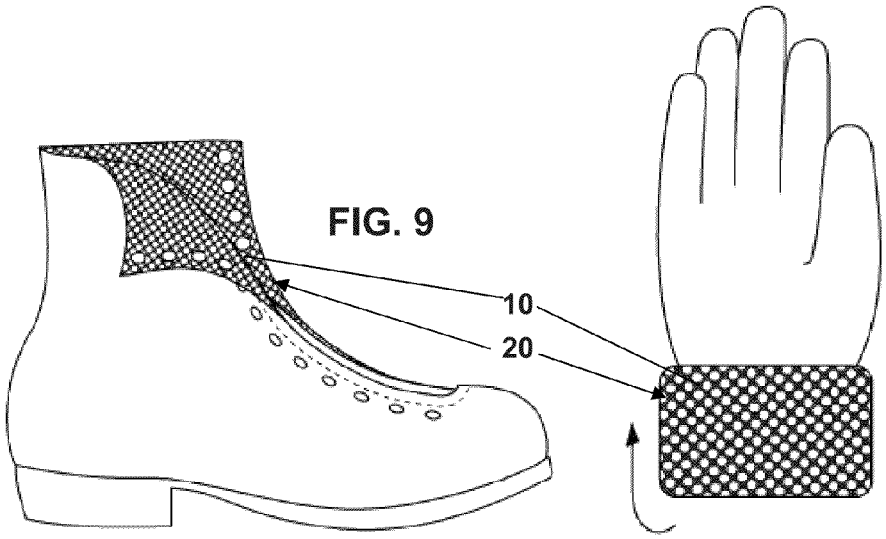
FIG. 9
FIG. 10
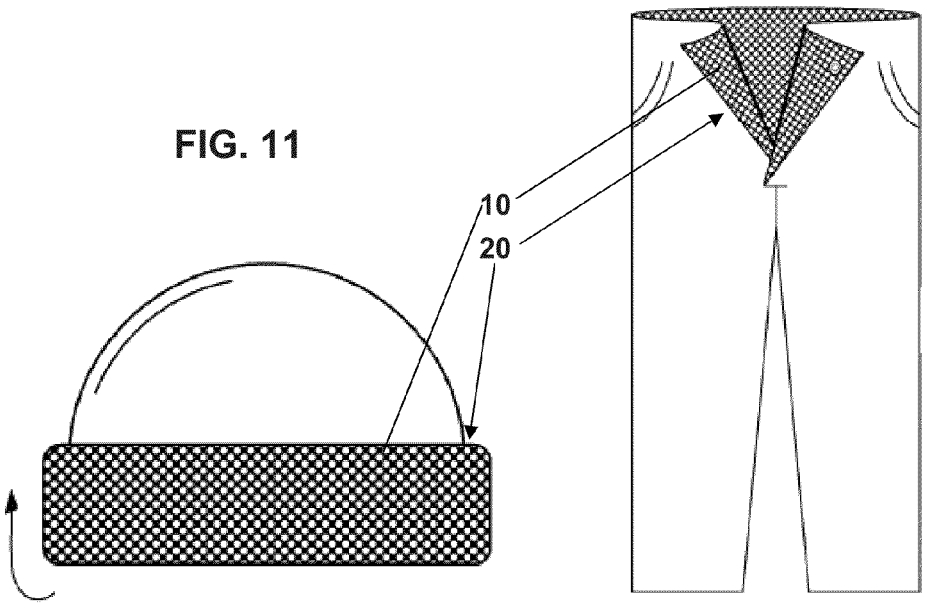
FIG. 11
FIG. 12

20
10

HOLOGRAPHIC PATTERNED HEAT MANAGEMENT MATERIAL

CROSS-REFERENCE TO RELATED APPLICATION

This application is a continuation-in-part of and claims the benefit of the filing date of U.S. patent application Ser. No. 12/776,306, filed May 7, 2010, which in turn claims the benefit of the filing date of U.S. Provisional Application No. 61/176,448, filed May 7, 2009, the disclosures of both of which are incorporated herein in their entirety. This present application is also a continuation-in-part of and claims the benefit of the filing dates of U.S. Design patent applications 29/385,768, filed in Feb. 18, 2011; 29/360,364, filed on Apr. 23, 2010; 29/346,787, filed on Nov. 5, 2009; 29/346,784, filed on Nov. 5, 2009; 29/346,785, filed on Nov. 5, 2009; 29/346,786, filed on Nov. 5, 2009; 29/346,788, filed on Nov. 5, 2009; and 29/336,730, filed on May 7, 2009, the disclosures of which are incorporated herein in their entirety.

TECHNICAL FIELD

Embodiments of the present disclosure relate generally to a fabric or other material used for body gear and other goods having designed performance characteristics, and in particular to methods and apparatuses that utilize a pattern of heat managing/directing elements coupled to a base fabric to manage heat through reflection or conductivity while maintaining the desired properties of the base fabric.

BACKGROUND

Currently, heat reflective materials such as aluminum and mylar typically take the form of a unitary solid film that is glued or otherwise attached to the interior of a garment, such as a jacket. The purpose of this layer is to inhibit thermal radiation by reflecting the body heat of the wearer and thereby keeping the garment wearer warm in colder conditions. However, these heat reflective linings do not transfer moisture vapor or allow air passage, thus they trap moisture near the body. Because the application of a heat reflective material impedes the breathability and other functions of the underlying base fabric, use of heat reflective materials during physical activity causes the inside of a garment to become wet, thereby causing discomfort and accelerating heat loss due to the increased heat conductivity inherent in wet materials. Further, these heat reflective coated materials impair the ability of the material to stretch, drape, or hang in a desired fashion.

BRIEF DESCRIPTION OF THE DRAWINGS

Embodiments of the present disclosure will be readily understood by the following detailed description in conjunction with the accompanying drawings. Embodiments of the invention are illustrated by way of example and not by way of limitation in the figures of the accompanying drawings.

FIG. 1A illustrates an upper body garment such as a coat having a lining of base material with heat-directing elements disposed thereon, in accordance with various embodiments;

FIGS. 1B-1E illustrate various views of examples of patterned heat-directing elements disposed on a base fabric or material, in accordance with various embodiments;

FIGS. 8A-D illustrate various views of a patterned heat management material as used in a jacket, in accordance with various embodiments;

FIG. 9 illustrates an example of a patterned heat management material as used in a boot, in accordance with various embodiments;

FIG. 10 illustrates an example of a patterned heat management material as used in a glove, where the cuff is rolled outward to show the lining, in accordance with various embodiments;

FIG. 11 illustrates an example of a patterned heat management material as used in a hat, in accordance with various embodiments;

FIG. 12 illustrates an example of a patterned heat management material as used in a pair of pants, in accordance with various embodiments;

DETAILED DESCRIPTION OF EMBODIMENTS

Figure 2A:
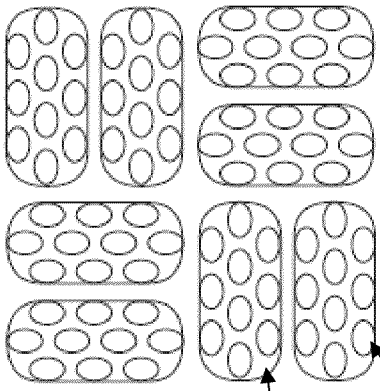
FIGS. 2A and 2B illustrate examples of patterned heat-directing elements disposed on a base fabric, in accordance with various embodiments.
Figure 2B:
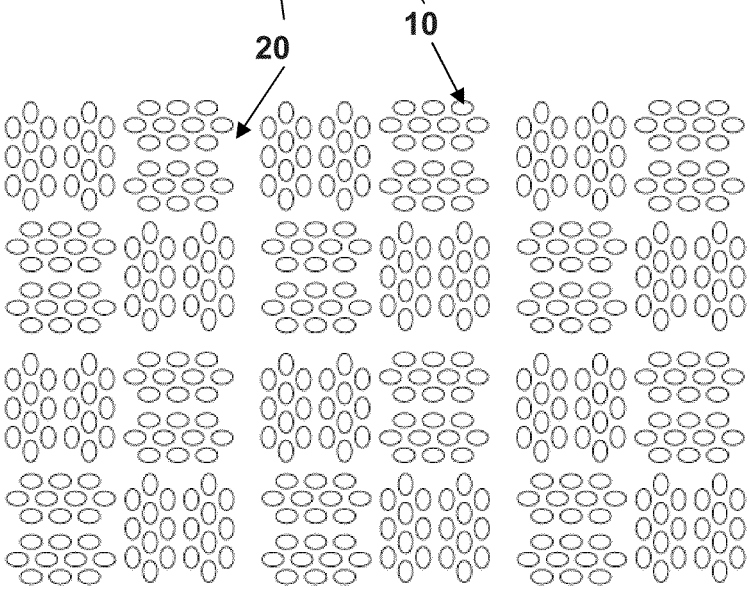
Figure 3A:
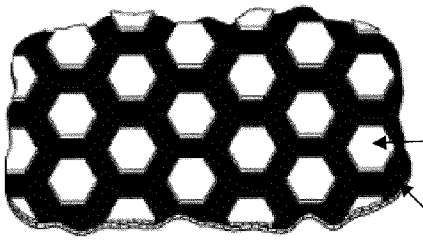
FIGS. 3A-3E illustrate examples of patterned heat-directing elements disposed on a base fabric, in accordance with various embodiments.
Figure 3B:
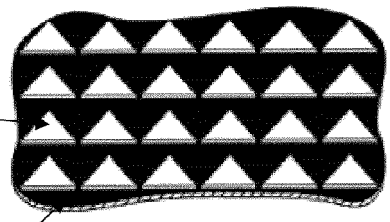
Figure 3C:
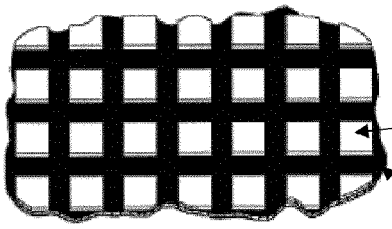
Figure 3E:
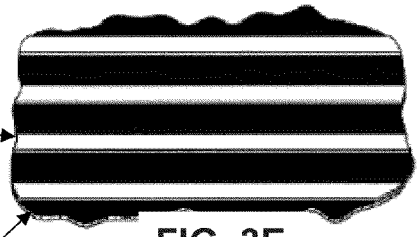
Figure 3D:
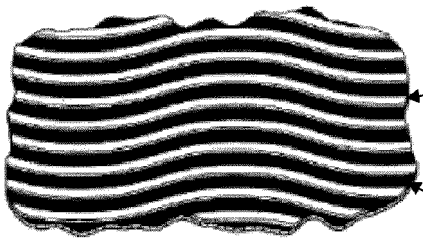
Figure 4:
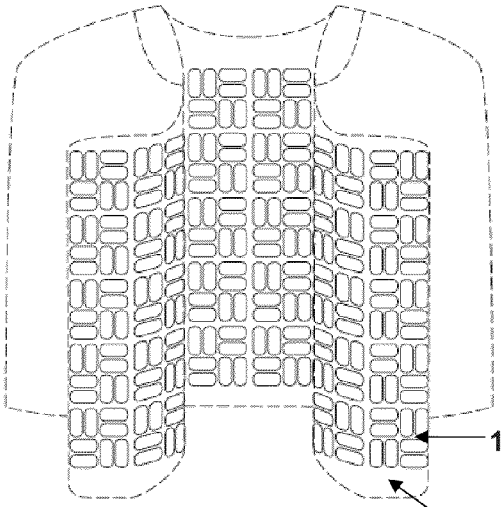
FIG. 4 illustrates an upper body garment such as a coat having a lining of base material with heat-directing elements disposed thereon, in accordance with various embodiments.
Figure 5:
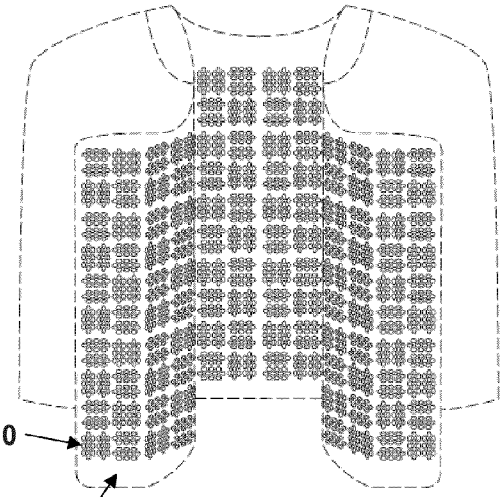
FIG. 5 illustrates an upper body garment such as a coat having a lining of base material with heat-directing elements disposed thereon, in accordance with various embodiments.
Figure 6:
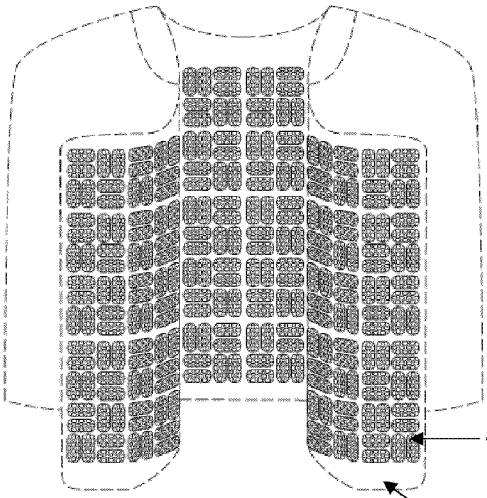
FIG. 6 illustrates an upper body garment such as a coat having a lining of base material with heat-directing elements disposed thereon, in accordance with various embodiments.
Figure 7:
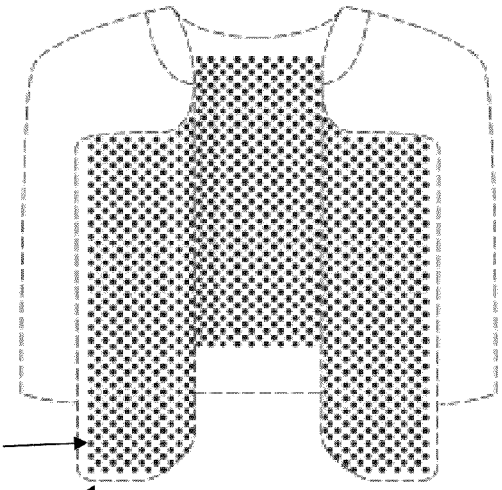
FIG. 7 illustrates an upper body garment such as a coat having a lining of base material with heat-directing elements disposed thereon, in accordance with various embodiments.

In the following detailed description, reference is made to the accompanying drawings which form a part hereof, and in which are shown by way of illustration embodiments in which the disclosure may be practiced. It is to be understood that other embodiments may be utilized and structural or logical changes may be made without departing from the scope of the present disclosure. Therefore, the following detailed description is not to be taken in a limiting sense, and the scopes of embodiments, in accordance with the present disclosure, are defined by the appended claims and their equivalents.

Various operations may be described as multiple discrete operations in turn, in a manner that may be helpful in understanding embodiments of the present invention; however, the order of description should not be construed to imply that these operations are order dependent.

The description may use perspective-based descriptions such as up/down, back/front, and top/bottom. Such descriptions are merely used to facilitate the discussion and are not intended to restrict the application of embodiments of the present invention.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the phrases "in an embodiment," or "in embodiments," which may each refer to one or more of the same or different embodiments. Furthermore, the terms "comprising," "including," "having," and the like, as used with respect to embodiments of the present invention, are synonymous.

In various embodiments a material for body gear is disclosed that may use a pattern of heat-directing elements coupled to a base fabric to manage, for example, body heat by directing the heat towards or away from the body as desired, while still maintaining the desired transfer properties of the base fabric. For example, referring to FIGS. 1B-1E, in one embodiment, a plurality of heat management or heat-directing elements 10 may be disposed on a base fabric 20 in a generally non-continuous array, whereby some of the base fabric is exposed between adjacent heat-directing elements. The heat-directing function of the heat-directing elements may be generally towards the body through reflectivity or away from the body through conduction and/or radiation or other heat transfer property.

The heat-directing elements 10 may cover a sufficient surface area of the base fabric 20 to generate the desired degree of heat management (e.g. heat reflection toward the body to enhance warmth, or heat conductance away from the body to help induce cooling). A sufficient area of base fabric may be exposed to provide the desired base fabric function (e.g., stretch, drape, breathability, moisture vapor or air permeability, or wicking).

Figures 13, 14:
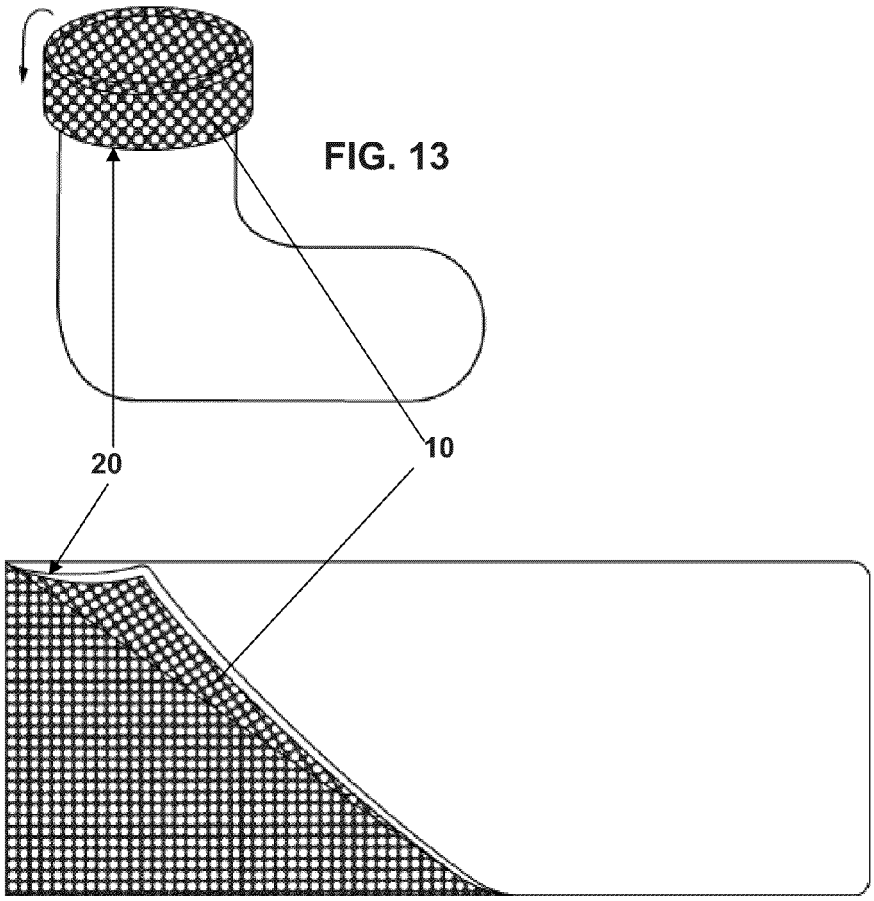
FIG. 13 illustrates an example of a patterned heat management material as used in a sock, in accordance with various embodiments.
FIG. 14 illustrates an example of a patterned heat management material as used in a boot, in accordance with various embodiments.

In accordance with various embodiments, the base fabric may be a part of any form of body gear, such as bodywear (see, e.g., FIGS. 1A and 4-13), sleeping bags (see, e.g., FIG. 14), blankets, tents (see, e.g., FIG. 15B), rain flys (see, e.g., FIG. 15A) etc. Bodywear, as used herein, is defined to include anything worn on the body, including, but not limited to, outerwear such as jackets, pants, scarves, shirts, hats, gloves, mittens, and the like, footwear such as shoes, boots, slippers, and the like, sleepwear, such as pajamas, nightgowns, and robes, and undergarments such as underwear, thermal underwear, socks, hosiery, and the like.

In various embodiments, single-layer body gear may be used and may be comprised of a single layer of the base fabric, whereas other embodiments may use multiple layers of fabric, including one or more layers of the base fabric, coupled to one or more other layers. For instance, the base fabric may be used as a fabric lining for body gear.

In various embodiments, the array of heat-directing elements may be disposed on a base fabric having one or more desired properties. For example, the underlying base material may have properties such as air permeability, moisture vapor transfer and/or wickability, which is a common need for body gear used in both indoor and outdoor applications. In other embodiments, the separations between heat-directing elements help allow the base material to have a desired drape, look, and/or texture. In some embodiments, the separations between heat-directing elements may help allow the base material to stretch. Suitable base fabrics may include nylon, polyester, rayon, cotton, spandex, wool, silk, or a blend thereof, or any other material having a desired look, feel, weight, thickness, weave, texture, or other desired property. In various embodiments, allowing a designated percentage of the base fabric to remain uncovered by the heat-directing elements may allow that portion of the base fabric to perform the desired functions, while leaving enough heat-directing element surface area to direct body heat in a desired direction, for instance away from or toward the body of a user.

For example, the heat-directing elements may be positioned in such a way and be made of a material that is conducive for directing heat generated by the body. In one embodiment, the heat-directing elements may be configured to reflect the user's body heat toward the user's body, which may be particularly suitable in cold environments. In another embodiment, the heat-directing elements may be configured to conduct the user's body heat away from the user's body, which may be particularly suitable in warmer environments. In particular embodiments, the heat-directing elements may be configured to generally reflect the user's body heat towards the user's body, but may also begin to conduct heat away from the user's body when the user begins to overheat.

In various embodiments, the base fabric may include heat-directing elements disposed on an innermost surface of the body gear such that the elements are disposed to face the user's body and thus are in a position to manage body heat, as discussed above (e.g., reflect heat or conduct heat). In some other embodiments, the heat-directing elements may be disposed on the exterior surface of the body gear and/or base fabric such that they are exposed to the environment, which may allow the heat-directing elements, for example, to reflect heat away from the user, while allowing the base fabric to adequately perform the desired functions. In some embodiments, the heat-directing elements may perform these functions without adversely affecting the stretch, drape, feel, or other properties of the base fabric.

In some embodiments, the heat-directing elements may include an aluminum-based material (particularly suited for reflectivity), chromium-based material (particularly suited for reflectivity), copper based material (particularly suited for conductivity), or another metal or metal alloy-based material. Non-metallic or alloy based materials may be used as heat-directing materials in some embodiments, such as metallic plastic, mylar, or other man-made materials, provided that they have heat reflective or conductive properties. In other embodiments, a heat-directing element may be a holographic heat-directing element, such as a holographic foil or embossed reflective surface. As used herein, in various embodiments, the term "holographic heat-directing element" may refer to a generally reflective metallic-colored element, such as a gold-colored, silver-colored, copper-colored, or other shiny metallic-colored element having a thin reflective or metallic layer (for example, from a few angstroms to a few microns thick), wherein the element may reflect heat and/or light in more than one direction. In some embodiments, a holographic heat-directing element may include a holographic image on its obverse side. For instance, in various embodiments, a holographic image may be produced by a laser-etched holographic foil. In other embodiments, a holographic element may produce non-specular reflection via an embossed pattern or collection of facets.

In various embodiments, a holographic foil may have a thin layer of adhesive material, such as a heat-sensitive adhesive, on its reverse side, although not all holographic foils include this layer. In various embodiments, the holographic foil may reflect a characteristic pattern of light when a light beam is directed at it. For instance, in various embodiments, a laser beam directed at a holographic foil of the present disclosure may reflect multiple light beams, such as 6-10 beams of light or even more, depending on the specific holographic pattern used. The holographic foil may also reflect other energy waves, other than light. In various embodiments, when located on an interior surface of a piece of body wear, the holographic heat-directing elements disclosed herein may direct a greater percentage of the body's heat back towards the body of the user, when compared to conventional heat-directing elements. Similarly, in various embodiments, when located on an exterior surface of a piece of body wear, the holographic heat-directing elements disclosed herein may direct a greater percentage of the incident heat away from the body of the user, when compared to conventional heat-directing elements.

Additionally, holographic heat-directing elements, particularly those affixed to the base fabric using heat-stamping techniques as described below, may not be easily removed in their entireties because of the very thin and fragile nature of the foil. Thus, in various embodiments, such holographic heat-directing elements also may serve an additional purpose of serving as an indication of a source for the body wear, for instance, by incorporating a logo or other identifying word or image into the holographic foil, which may make it easier to detect and/or deter counterfeiting in some embodiments. In various embodiments, the heat-directing elements disclosed herein may be permanently coupled to the base fabric in a variety of ways, including, but not limited to gluing, heat pressing, printing, or stitching. In some embodiments, the heat-directing elements may be coupled to the base fabric by frequency welding, such as by radio or ultrasonic welding.

In some embodiments wherein the heat-directing elements are holographic elements, the heat-directing elements may be coupled to the base fabric using a process described in U.S. Pat. No. 5,464,690, which is incorporated by reference herein. Briefly, in some embodiments, a holographic foil made from a composite sheet having a holographic image applied thereto may be transferred from a carrier film (such as a polyester, polypropylene, or similar material) to a substrate (such as the base fabric disclosed herein) where it may be affixed by an adhesive film opposite the carrier film using a heat-stamping process. Modifications to this process, such as those described in U.S. Pat. Nos. 5,674,580; 5,643,678; 5,653,349; and 6,638,386, which are incorporated by reference in their entirety, also may be used to affix the holographic heat-directing elements to the base fabric in various embodiments. Other embodiments may make use of a holographic thermal transfer ribbon for enabling the transfer of a hologram using a thermal transfer demand printer, as disclosed in U.S. Pat. No. 5,342,672, which is incorporated by reference in its entirety.

In various embodiments, the heat-directing properties of the heat-directing elements may be influenced by the composition of the base fabric or the overall construction of the body gear. For example, a base fabric may be used that has significant insulating properties. When paired with heat-directing elements that have heat reflective properties, the insulative backing/lining may help limit any conductivity that may naturally occur and enhance the reflective properties of the heat-directing elements. In another example, the base fabric may provide little or no insulative properties, but may be coupled to an insulating layer disposed on the side of the base fabric opposite the heat-directing material elements. The separate insulation layer may help reduce the potential for heat conductivity of the elements and enhance their reflectivity. In some embodiments, the heat-directing elements may become more conductive as the air layer between the garment and the wearer becomes more warm and humid. Such examples may be suitable for use in cold weather applications, for instance.

In various embodiments, a base fabric may be used that has little or no insulative properties. When paired with heat-directing elements that are primarily configured to conduct heat, as opposed to reflecting heat, the base fabric and heat-directing elements may aid in removing excess body heat generated in warmer climates or when engaging in extreme physical activity. Such embodiments may be suitable for warm weather conditions.

In various embodiments, the heat-directing elements may be applied in a pattern or a continuous or discontinuous array defined by the manufacturer. For example, as illustrated in FIGS. 1A-1E, heat-directing elements 10, may be a series of dot-like heat reflective (or heat conductive) elements adhered or otherwise secured to the base fabric 20 in a desired pattern. Such a configuration has been found to provide heat reflectivity and thus warmth to the user (e.g., when heat reflective elements are used), or, in the alternative, heat conduction and thus cooling to the user (e.g., when heat conductive elements are used), while still allowing the base fabric to perform the function of the desired one or more properties (e.g. breathe and allow moisture vapor to escape through the fabric in order to reduce the level of moisture build up).

Although the illustrated embodiments show the heat-directing elements as discrete elements, in some embodiments, some or all of the heat-directing elements may be arranged such that they are in connection with one another, such as a lattice pattern or any other pattern that permits partial coverage of the base fabric.

In various embodiments, the configuration or pattern of the heat-directing elements themselves may be selected by the user and may take any one of a variety of forms. For example, as illustrated in FIGS. 2A-2B, 3A-3E, and 4-6, the configuration of the heat-directing elements 10 disposed on a base fabric 20 used for body gear may be in the form of a variety of geometrical patterns (e.g. lines, waves, triangles, squares, logos, words, etc.)

In various embodiments, the pattern of heat-directing elements may be symmetric, ordered, random, and/or asymmetrical. Further, as discussed below, the pattern of heat-directing elements may be disposed on the base material at strategic locations to improve the performance of the body wear. In various embodiments, the size of the heat-directing elements may also be varied to balance the need for enhanced heat-directing properties and preserve the functionality of the base fabric.

In various embodiments, the density or ratio of the surface area covered by the heat-directing elements to the surface are of base fabric left uncovered by the heat-directing elements may be from about 3:7 (30%) to about 7:3 (70%). In various embodiments, this range has been shown to provide a good balance of heat management properties (e.g., reflectivity or conductivity) with the desired properties of the base fabric (e.g., breathability or wicking, for instance). In particular embodiments, this ratio may be from about 4:6 (40%) to about 6:4 (60%).

In various embodiments, the placement, pattern, and/or coverage ratio of the heat-directing elements may vary. For example the heat-directing elements may be concentrated in certain areas where heat management may be more critical (e.g. the body core) and non existent or extremely limited in other areas where the function of the base fabric property is more critical (e.g. area under the arms or portions of the back for wicking moisture away from the body). In various embodiments, different areas of the body gear may have different coverage ratios, e.g. 70% at the chest and 30% at the limbs, in order to help optimize, for example, the need for warmth and breathability.

In various embodiments, the size of the heat-directing elements may be largest (or the spacing between them may be the smallest) in the core regions of the body for enhanced reflection or conduction in those areas, and the size of the heat-directing elements may be the smallest (or the spacing between them may be the largest) in peripheral areas of the body. In some embodiments, the degree of coverage by the heat-directing elements may vary in a gradual fashion over the entire garments as needed for regional heat management. Some embodiments may employ heat reflective elements in some areas and heat conductive elements in other areas of the garment.

In various embodiments, the heat-directing elements may be configured to help resist moisture buildup on the heat-directing elements themselves and further enhance the function of the base fabric (e.g. breathability or moisture wicking). In one embodiment, it has been found that reducing the area of individual elements, but increasing the density may provide a better balance between heat direction (e.g. reflectivity or conductivity) and base fabric functionality, as there will be a reduced tendency for moisture to build up on the heat-directing elements. In some embodiments, it has been found that keeping the surface area of the individual heat-directing elements below 1 $cm^2$ can help to reduce the potential for moisture build up. In various embodiments, the heat-directing elements may have a maximum dimension (diameter, hypotenuse, length, width, etc.) that is less than or equal to about 1 cm. In some embodiments, the maximum dimension may be between 1-4 mm. In other embodiments, the largest dimension of a heat-directing element may be as small as 1 mm, or even smaller.

Figure 16A:
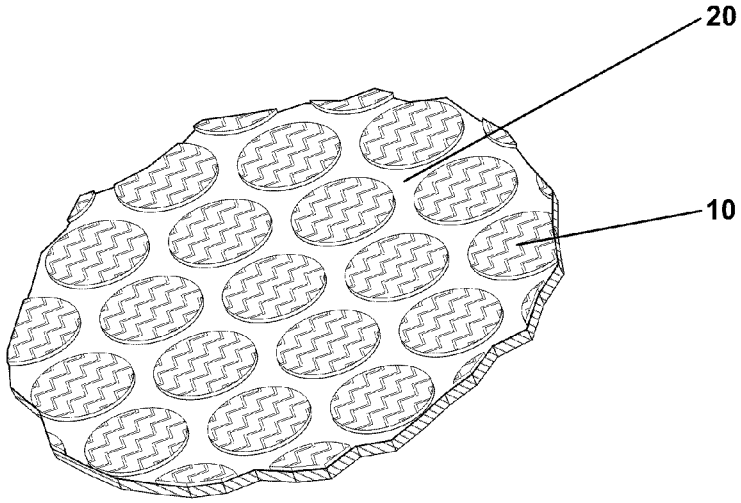
FIGS. 16A-16D illustrate examples of holographic patterned heat-directing elements disposed on a base fabric or material in a perspective view (FIG. 16A), in a cross-sectional view (FIG. 16B), in a face view (FIG. 16C), and in use in a jacket lining (FIG. 16D), in accordance with various embodiments.
Figure 16B:
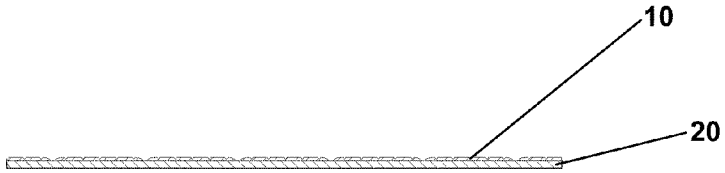
Figure 16C:
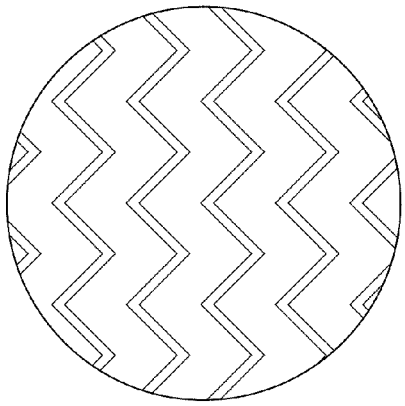
Figure 16D:
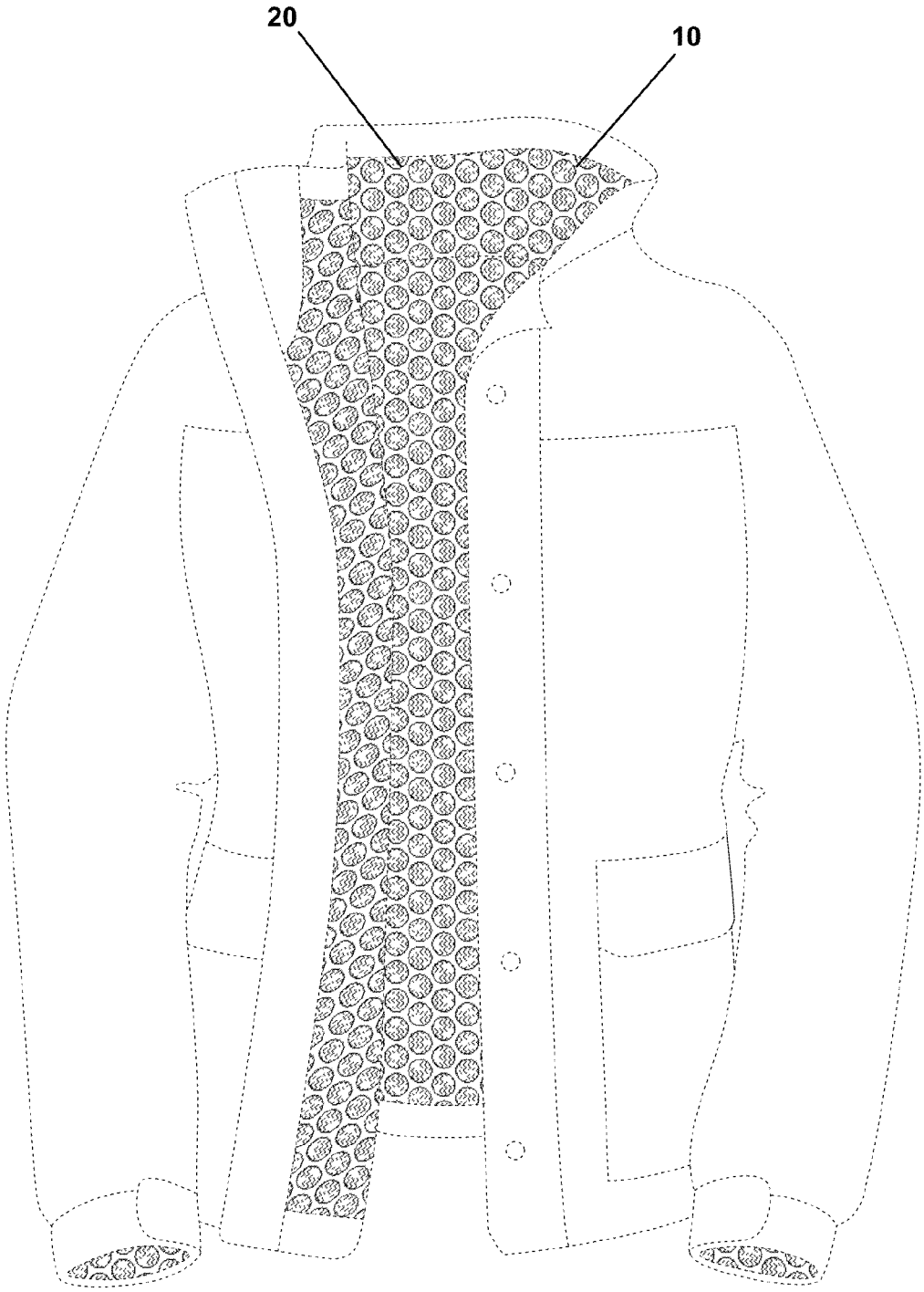
Figure 17A:
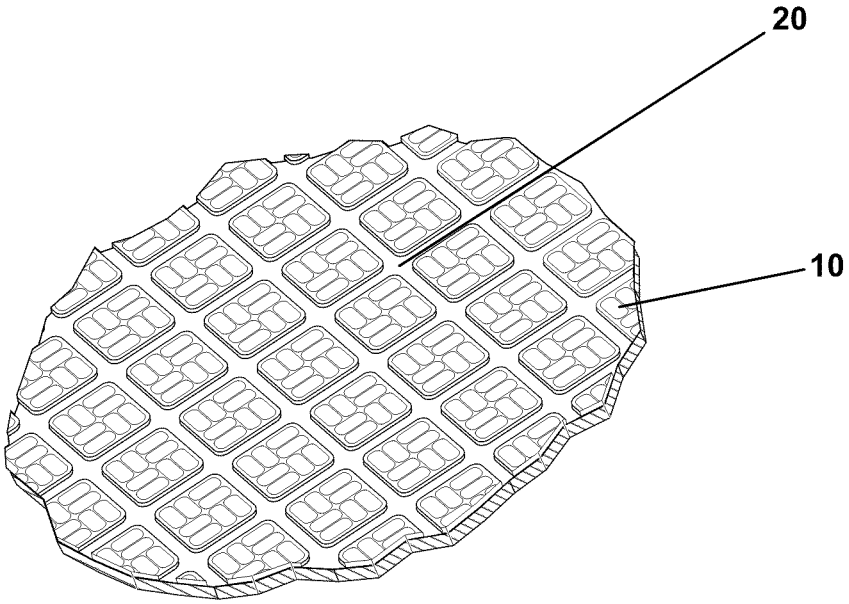
FIGS. 17A and 17B illustrate another example of holographic patterned heat-directing elements disposed on a base fabric or material in a perspective view (FIG. 17A), and in use in a jacket lining (FIG. 17B), in accordance with various embodiments.
Figure 17B:
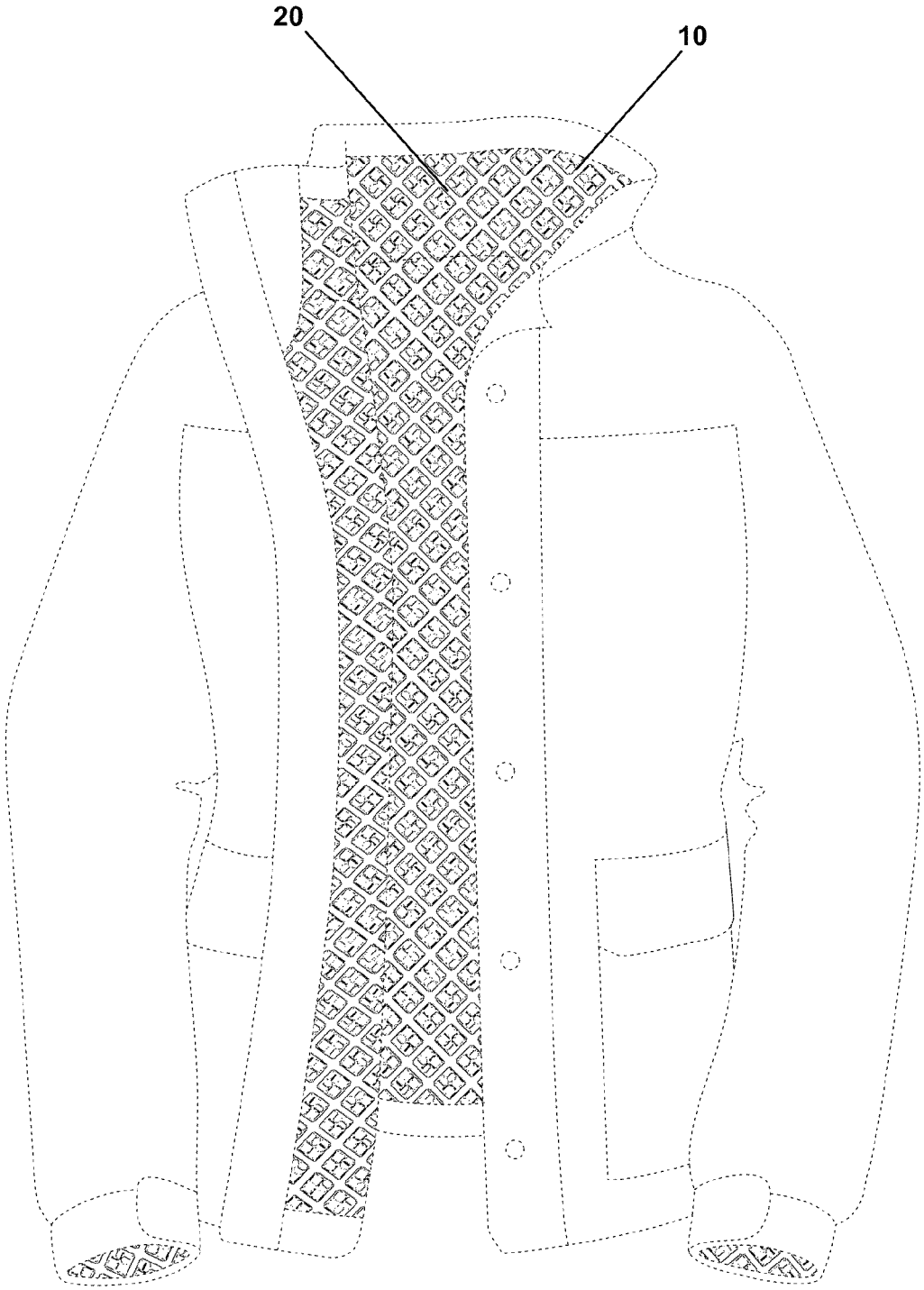

In some embodiments, for instance when the heat-directing elements are holographic elements, the size and shape of the heat-directing elements may be selected to suit the particular hologram etched on the foil, for instance a logo, company name, picture, or other insignia. For example, the size of the heat-directing element may be selected to be large enough such that the hologram is visible to a user, for instance a holographic font may be large enough to be read without the need for additional equipment. Thus, in some embodiments, a holographic heat-directing element may be about 1 cm or larger, for instance, 2, 3, 4, or even 5 cm. FIGS. 16A-16D illustrate examples of such holographic patterned heat-directing elements disposed on a base fabric or material in a perspective view (FIG. 16A), in a cross-sectional view (FIG. 16B), in a face view (FIG. 16C), and in use in a jacket lining (FIG. 16D); FIGS. 17A and 17B illustrate another example of holographic patterned heat-directing elements disposed on a base fabric or material in a perspective view (FIG. 17A), and in use in a jacket lining (FIG. 17B), all in accordance with various embodiments.

Figure 18A:
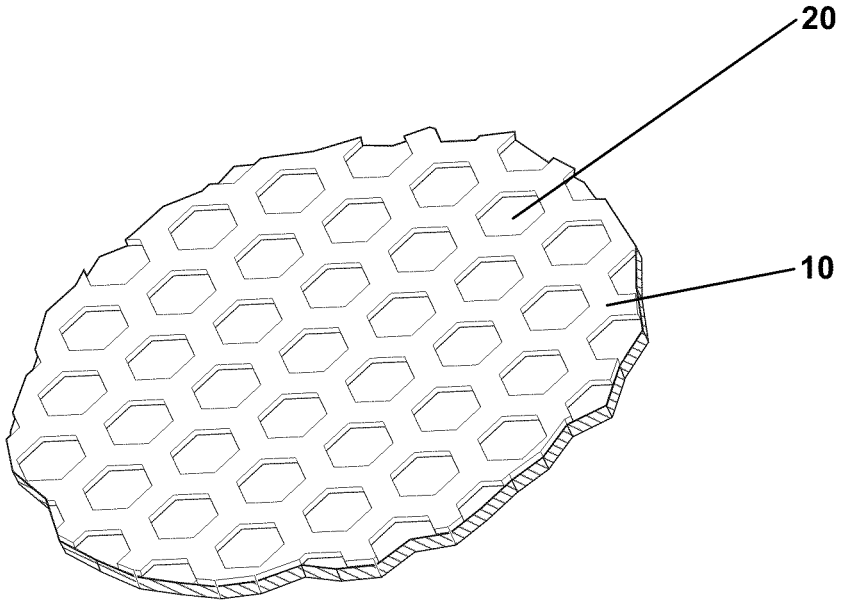
FIGS. 18A and 18B illustrate another example of holographic patterned heat-directing elements disposed on a base fabric or material in a perspective view (FIG. 18A), and in use in a jacket lining (FIG. 18B), in accordance with various embodiments.
Figure 18B:
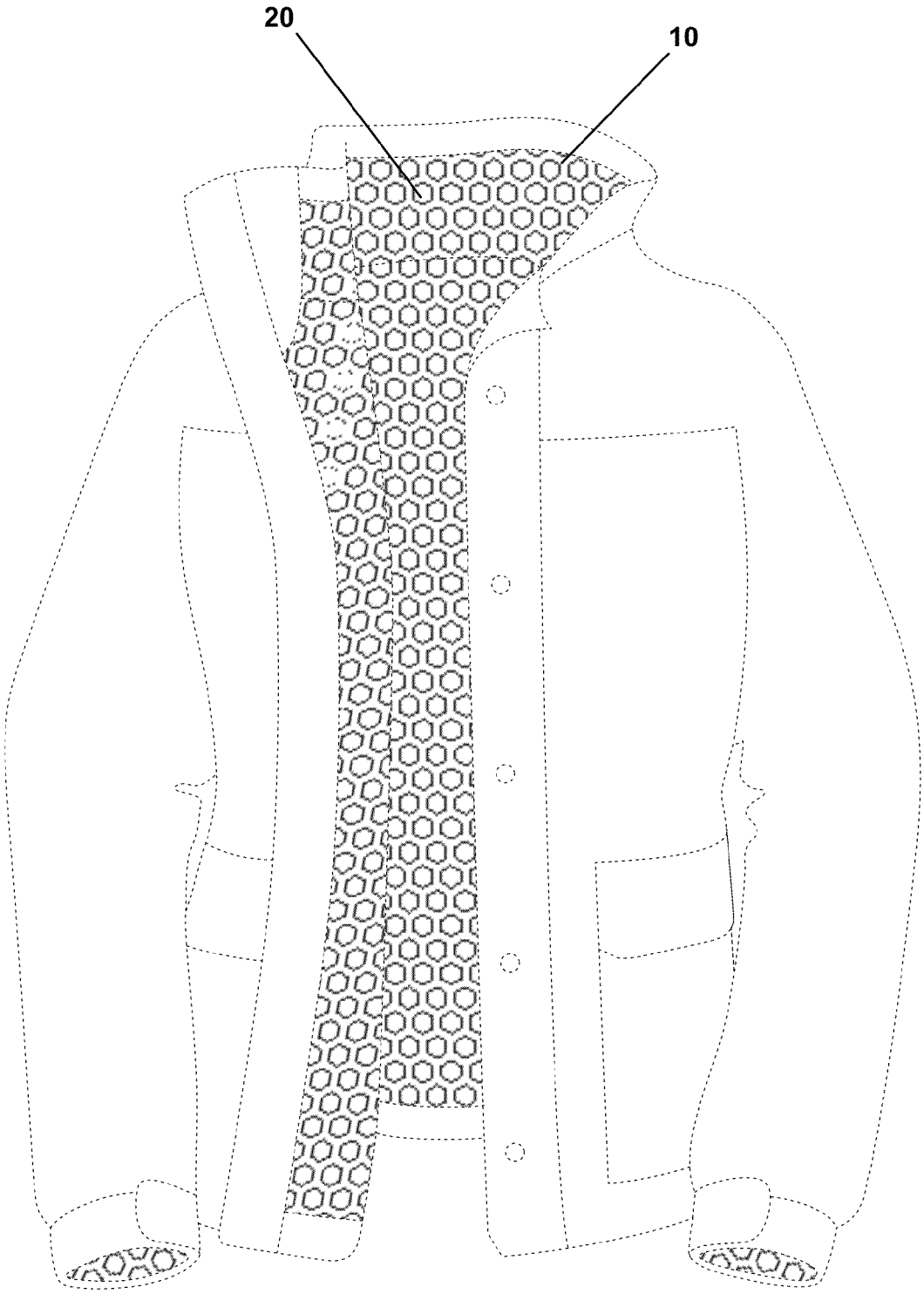

In various embodiments, holographic heat-directing elements may be configured in an inverse pattern from that shown in FIG. 1, with the heat-directing elements forming a lattice or other interconnected pattern, with base fabric appearing as a pattern of dots or other shapes. For example, FIGS. 18A and 18B illustrate a lattice-pattern of holographic patterned heat-directing elements disposed on a base fabric or material in a perspective view (FIG. 18A), and in use in a jacket lining (FIG. 18B), in accordance with various embodiments. Although a lattice pattern is illustrated, one of skill in the art will appreciate that any pattern or combination of patterns may be employed.

In some embodiments, the topographic profile of the individual heat-directing elements can be such that moisture is not inclined to adhere to the heat-directing element. For example, the heat-directing element may be convex, conical, fluted, or otherwise protruded, which may help urge moisture to flow towards the base fabric. In some embodiments, the surface of the heat-directing elements may be treated with a compound that may help resist the build up of moisture vapor onto the elements and better direct the moisture to the base fabric without materially impacting the thermal directing property of the elements. One such example treatment may be a hydrophobic fluorocarbon, which may be applied to the elements via lamination, spray deposition, or in a chemical bath.

In various embodiments, the heat-directing elements may be removable from the base fabric and reconfigurable if desired using a variety of releasable coupling fasteners such as zippers, snaps, buttons, hook and loop type fasteners (e.g. Velcro), and other detachable interfaces. Further, the base material may be formed as a separate item of body gear and used in conjunction with other body gear to improve thermal management of a user's body heat. For example, an upper body under wear garment may be composed with heat-directing elements in accordance with various embodiments. This under wear garment may be worn by a user alone, in which case conduction of body heat away from the user's body may typically occur, or in conjunction with an insulated outer garment which may enhance the heat reflectivity of the user's body heat.

In various embodiments, the heat-directing elements may be applied to the base fabric such that it is depressed, concave, or recessed relative to the base fabric, such that the surface of the heat-directing element is disposed below the surface of the base fabric. This configuration may have the effect of improving, for example, moisture wicking, as the base fabric is the portion of the body gear or body gear lining that engages the user's skin or underlying clothing. Further, such contact with the base fabric may also enhance the comfort to the wearer of the body gear in applications where the skin is in direct contact with the base fabric (e.g. gloves, mittens, underwear, or socks).

Figures 15A, 15B:
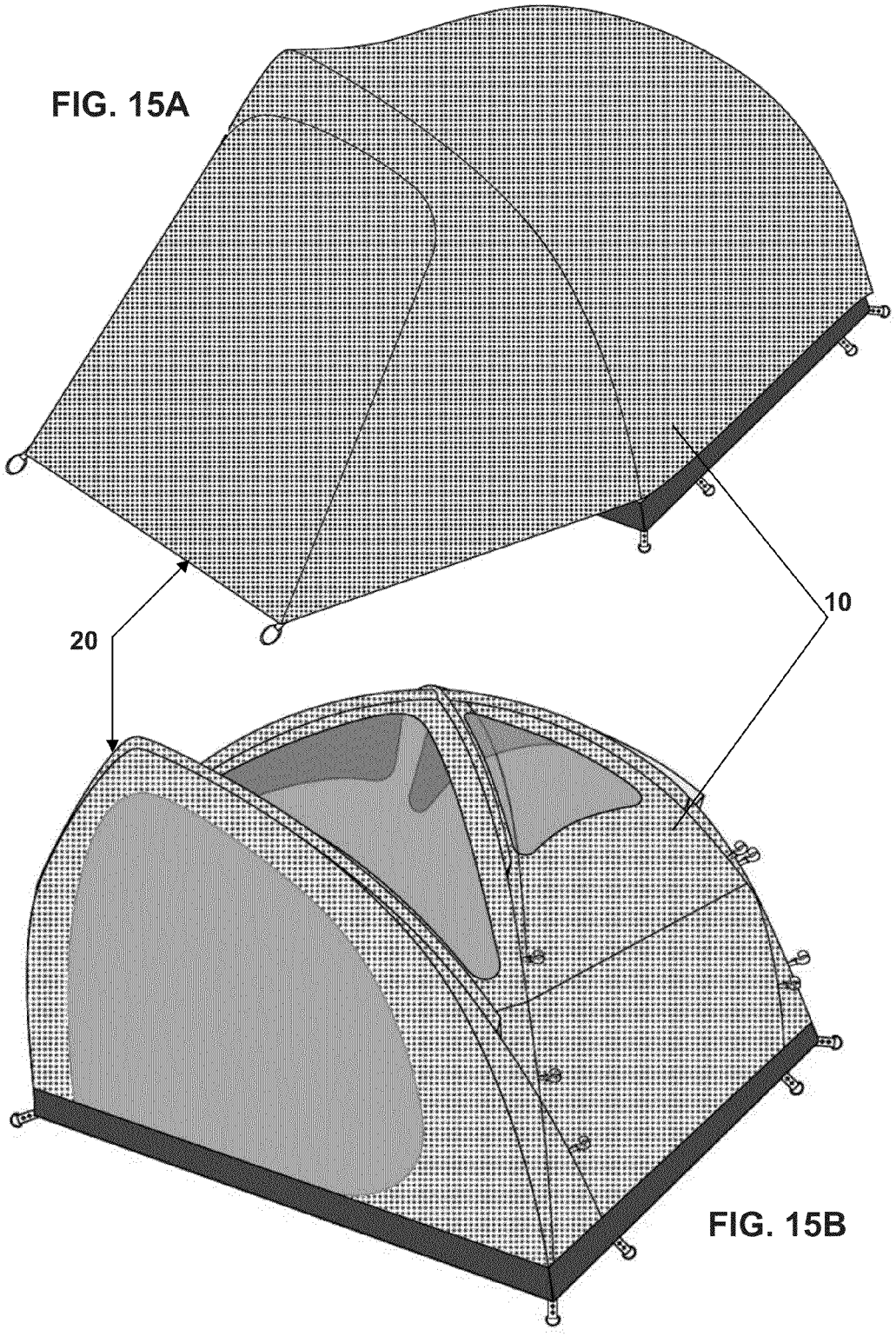
FIGS. 15A and B illustrate two views of a patterned heat management material as used in a reversible rain fly (FIG. 15A) and as a portion of a tent body (FIG. 15B), in accordance with various embodiments.

FIGS. 8-15 illustrate various views of a patterned heat management fabric used in a variety of body gear applications, such as a jacket (FIGS. 8A-D), boot (FIG. 9), glove (FIG. 10), hat (FIG. 11), pants (FIG. 12), sock (FIG. 13), sleeping bag (FIG. 14), tent rain fly (FIG. 15A) and tent (FIG. 15B). Each of the body gear pieces illustrated include a base material 20 having a plurality of heat-directing elements 10 disposed thereon.

While the principle embodiments described herein include heat-directing elements that are disposed on the inner surface of the base fabric, in various embodiments, the heat-directing elements may be used on the outside of body gear, for instance to reflect or direct heat exposed to the outside surface of the gear. For instance, in some embodiments, base fabric and heat reflective elements, such as those illustrated in FIGS. 1B-3E, may be applied to an outer or exterior surface of the body gear, such as a coat, sleeping bag, tent or tent rain fly, etc in order to reflect heat away from the user.

In some embodiments, the body gear may be reversible, such that a user may determine whether to use the fabric to direct heat toward the body or away from the body. An example of such reversible body gear is illustrated in FIG. 15A. In this embodiment, the heat-directing elements may be included on one side of a tent rain fly. In one embodiment, the rain fly may be used with the heat-directing elements facing outward, for example in hot weather or sunny conditions, in order to reflect heat away from the body of the tent user. Conversely, in cold weather conditions, for example, the tent rain fly may be reversed and installed with the heat-directing elements facing inward, toward the body of a user, so as to reflect body heat back toward the tent interior. Although a tent rain fly is used to illustrate this principle, one of skill in the art will appreciate that the same concept may be applied to other body gear, such as reversible jackets, coats, hats, and the like. FIG. 15B illustrates an example wherein at least a portion of the tent body includes a fabric having a plurality of heat-directing elements disposed thereon. In the illustrated embodiment, the heat reflective elements are facing outward and may be configured to reflect heat away from the tent and thus away from the body of the tent user. In other embodiments, the elements may be configured to face inward.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope of the present invention. Those with skill in the art will readily appreciate that embodiments in accordance with the present invention may be implemented in a very wide variety of ways. This application is intended to cover any adaptations or variations of the embodiments discussed herein. Therefore, it is manifestly intended that embodiments in accordance with the present invention be limited only by the claims and the equivalents thereof.

We claim the following:

1. A holographic heat management material adapted for use with body gear, comprising:

a base material having a transfer property that is adapted to allow passage of moisture and/or water vapor through the base material;

an array of holographic heat-directing elements coupled to a first side of the base material, the holographic heat-directing elements being positioned to direct heat in a desired direction, and wherein the placement and spacing of the holographic heat-directing elements permits the base material to retain partial performance of the transfer property.

2. The holographic heat management material of claim 1, wherein the base material comprises an innermost layer of the body gear, and wherein the holographic heat-directing elements are positioned to face inward and direct heat towards the body of a body gear user.

3. The holographic heat management material of claim 1, wherein the base material comprises an outermost layer of the body gear, and wherein the holographic heat-directing elements are positioned on the material such that they face outward and direct heat away from the body of a body gear user.

4. The holographic heat management material of claim 1, wherein the base material is a moisture-wicking fabric.

5. The holographic heat management material of claim 1, wherein the base material comprises one or more insulating or waterproof materials.

6. The holographic heat management material of claim 1, wherein the base material is coupled to an insulating or waterproof material disposed on an opposite side as the holographic heat-directing elements.

7. The holographic heat management material of claim 1, wherein the surface area ratio of holographic heat-directing elements to base material is from about 7:3 to about 3:7.

8. The holographic heat management material of claim 7, wherein the surface area ratio of holographic heat-directing elements to base material is from about 3:2 to about 2:3.

9. The holographic heat management material of claim 1, wherein the holographic heat-directing elements comprise a laser-etched layer.

10. The holographic heat management material of claim 9, wherein the holographic heat-directing elements comprise a metal or metal alloy.

11. The holographic heat management material of claim 1, wherein the holographic heat-directing elements have a maximum dimension of less than about 5 cm.

12. The holographic heat management material of claim 1, wherein the holographic heat-directing elements are treated with a hydrophobic material to resist moisture build up on the holographic heat-directing elements.

13. The holographic heat management material of claim 1, wherein the holographic heat-directing elements have a maximum spacing of less than about 1 cm.

14. The holographic heat management material of claim 1, wherein the holographic heat-directing elements have a minimum spacing of more than about 1 mm.

15. The holographic heat management material of claim 1, wherein the material is part of a coat, jacket, shoe, boot, slipper, glove, mitten, hat, scarf, pants, sock, tent, rain fly, or sleeping bag.

16. The holographic heat management material of claim 1, wherein the holographic heat-directing elements are heat-stamped.

17. The holographic heat management material of claim 1, wherein the holographic heat-directing elements are recessed into the base material such that the outer surface of the holographic heat-directing element is below the surface of the base material.

18. A method of making a holographic heat management body gear material, comprising:

coupling an array of holographic heat-directing elements to a base material having a transfer functionality that is adapted to allow passage of moisture and/or water vapor through the base material, the holographic heat-directing elements being positioned to direct heat in a desired direction, and configured to display a holographic image;

pairing the holographic heat management body gear material with a piece of body gear; and providing, with the material, body heat management and base material functionality.

19. The method of claim 18, wherein coupling the holographic heat-directing elements comprises coupling holographic heat-directing elements of a size and spacing to cover from about 30% to about 70% of the base material.

20. The method of claim 18, wherein coupling the holographic heat-directing elements comprises coupling holographic heat-directing elements such that there is a spacing of between about 2 mm and 1 cm between adjacent elements.

21. The method of claim 18, wherein the base material further provides insulating properties, and wherein the holographic heat-directing material elements reflect heat toward a body of a user.

22. The method of claim 18, wherein the base material does not provide significant insulating properties, and wherein the holographic heat-directing material elements conduct heat away from a body of a user.

23. The method of claim 18, further comprising treating the holographic heat-directing elements with a hydrophobic treatment that will resist moisture buildup on the holographic heat-directing elements.

24. The method of claim 18, wherein providing body heat management and base material transfer functionality includes:

providing the holographic heat-directing elements adapted to conduct heat away from a wearer's body or reflect heat towards the wearer's body; and providing a base material that includes one or more functional characteristics including air permeability, moisture wicking, and thermal permeability.

25. The holographic heat management material of claim 1, wherein the holographic heat-directing elements display a holographic image.

26. The holographic heat management material of claim 25, wherein the holographic image comprises a font, a word, or a picture.

27. The holographic heat management material of claim 25, wherein the holographic image is configured to indicate a source of the heat management material and/or to aid in counterfeit detection.

* * * * *